United States Patent [19]

Black, Jr. et al.

[11] Patent Number: 4,937,504

[45] Date of Patent: Jun. 26, 1990

[54] TIME DELAY INITIALIZATION CIRCUIT

[75] Inventors: Robert A. Black, Jr., Brooklyn Park; Arlon D. Kompelien, Cross Lake, both of Minn.

[73] Assignee: Honeywell Inc., Minneapolis, Minn.

[21] Appl. No.: 239,111

[22] Filed: Aug. 31, 1988

[51] Int. Cl.[5] ..... H05B 41/36

[52] U.S. Cl. ..... 315/307; 315/287; 315/360; 315/DIG. 4; 315/DIG. 5

[58] Field of Search ..... 315/289, 291, 307, 308, 315/360, DIG. 4, DIG. 5

[56] References Cited

U.S. PATENT DOCUMENTS

| | | | |
|---|---|---|---|
| 3,577,011 | 4/1971 | Raffaelli | 307/252 C |
| 3,768,024 | 10/1974 | Letosky | 328/150 |
| 3,950,640 | 4/1976 | Webb et al. | 250/205 |
| 3,956,644 | 5/1976 | Zambre | 307/252 |
| 4,051,394 | 9/1977 | Tieden | 307/310 |
| 4,135,116 | 1/1979 | Smith | 315/158 |
| 4,197,485 | 4/1980 | Nuver | 315/291 |
| 4,229,669 | 10/1980 | Smith | 307/354 |
| 4,231,083 | 10/1980 | Matsuda et al. | 363/135 |
| 4,286,195 | 8/1981 | Swinea, Jr. | 315/291 X |
| 4,322,767 | 3/1982 | El Hamamsy et al. | 361/56 |
| 4,346,331 | 8/1982 | Hoge | 315/158 |
| 4,350,935 | 9/1982 | Spira | 315/291 |
| 4,376,969 | 3/1983 | Bedard et al. | 363/78 |
| 4,414,493 | 11/1983 | Henrich | 315/308 |
| 4,455,509 | 6/1984 | Crum et al. | 315/119 |
| 4,464,606 | 8/1984 | Kane | 315/158 |
| 4,476,414 | 10/1984 | Jimerson | 315/240 |
| 4,492,975 | 1/1985 | Yamada et al. | 357/76 |
| 4,527,099 | 4/1985 | Capewell et al. | 315/291 |
| 4,587,459 | 5/1986 | Blake | 315/158 |
| 4,598,198 | 7/1986 | Fayfield | 250/205 |
| 4,687,950 | 8/1987 | Howell | 307/642 |
| 4,697,122 | 9/1987 | Hoffer | 315/158 |

*Primary Examiner*—David Mis

*Attorney, Agent, or Firm*—Kinney & Lange

[57] ABSTRACT

Apparatus for use with a fluorescent light dimming circuit to delay the application of power to the lamp for a first time period sufficient to allow the electronic components to stabilize and thereafter to delay any dimming signal to the lamp and, instead, apply full power to the lamp for a time period sufficient to allow the filament of the lamp to warm up.

17 Claims, 2 Drawing Sheets

NOR

| $P_1$ | $P_2$ | $P_3$ |
|---|---|---|
| 0 | 0 | 1 |
| 0 | 1 | 0 |
| 1 | 0 | 0 |
| 1 | 1 | 0 |

NAND

| $P_1$ | $P_2$ | $P_3$ |
|---|---|---|
| 0 | 0 | 1 |
| 0 | 1 | 1 |
| 1 | 0 | 1 |
| 1 | 1 | 0 |

NAND LATCH

| $P_1$ | $P_2$ | $P_3$ | $P_4$ |
|---|---|---|---|
| 0 | 0 | 1 | 1 |
| 0 | 1 | 1 | 0 |
| 1 | 0 | 0 | 1 |
| 1 | 1 | N.C. | N.C. |

TIME DELAY INITIALIZATION CIRCUIT

BACKGROUND OF THE INVENTION

1. Field of the Invention.

The present invention relates to a control system particularly for use with fluorescent lights and, more particularly, to an initialization circuit which operates to delay the application of a signal calling for dimming of a fluorescent light for a predetermined time period.

2. Reference to Other Applications

Two other U.S. patent applications Nos. 239,209 and 246,952, in the names of the present inventors and assigned to the present assignee entitled "Power Control Circuit for Inductive Loads" and "Notch Cutting Circuit with Minimal Power Dissipation," respectively, have been filed on even date herewith, and disclose and claim circuitry useful in cooperation with the present invention.

3. Description of the Prior Art.

In a co-pending application Ser. No. 898,569 filed Aug. 21, 1986, in the name of L. S. Atherton, R. A. Black, Jr., and A. D. Kompelien, and assigned to the assignee of the present invention, a circuit is described which provides fluorescent light dimming by creating a "notch" and controlling the width and position thereof along the alternating waveform produced by the power supply which energizes the fluorescent light. In this co-pending application, the power to the inductive ballast of a fluorescent light is interrupted for a short period of time on both the positive and negative half cycles of the power supply so as to provide a waveform with a "notch" in each half cycle. The position and width of these "notches" operate to vary the power supplied to the ballast and thus provide the desired dimming.

It has been discovered that upon starting the system after it has been "off" for a period of time with the signal calling for dimming of the fluorescent light, the life of the fluorescent light is undesirably shortened. This is because the filament or cathode of the tube needs at least ten to fifteen seconds to warm up before it can properly accept a signal calling for dimming of the fluorescent light. Applying a dimming signal too early after the initial starting thereof causes undue wear on the light and shortens its life.

It would be desirable to always initially start the fluorescent light control system in a "full on" condition for a predetermined period of time sufficient to allow the filament to become fully activated before producing the dimming control signal. It is also desirable to wait a couple of seconds before applying even the "full on" signal so as to allow stabilization of the electronic components in the control circuitry.

SUMMARY OF THE INVENTION

The present invention operates to provide a two or three second delay in the control signal before applying any signal to the fluorescent lights and then apply a "full on" signal thereto for another ten or so seconds upon initial starting of the system or after the system is "off" for any period of time. The first delay lasts for a period sufficient to allow the electronic components to become fully operative before applying any signal to the fluorescent lights and the second delay applies a "full on" signal for a period sufficient to allow the fluorescent light filament to warm up before the dimming control signal is finally applied. This is accomplished by use of unique signal delay circuitry that first inactivates the control circuit for a few seconds and then produces an output which resets a counter that is used to drive the dimming signal for the fluorescent lights and thus to provide a "full on" signal thereto for another, slightly longer delay period.

DETAILED DESCRIPTION OF THE PREFERRED EMBODIMENTS

Figure 1:
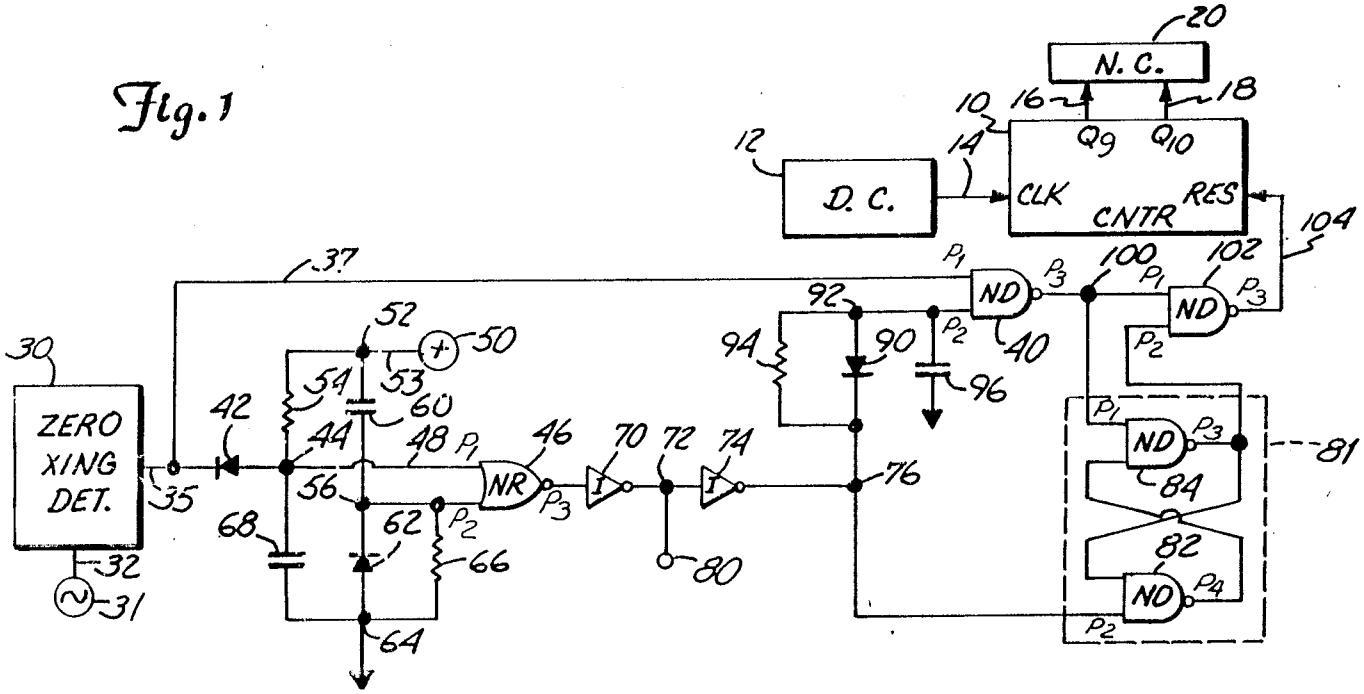
FIG. 1 is a schematic diagram of the present invention.

In FIG. 1, a counter 10 is shown receiving a clock input from a dimming circuit 12 over a line shown as arrow 14. Counter 10 and dimming circuit 12 may be the same as those described in the above-mentioned co-pending application. Counter 10 produces output signals at terminals identified as Q9 and Q10 over lines shown as arrows 16 and 18 to a notch cutting circuit 20 which may also be like that shown in the above-mentioned co-pending application or may be like the notch cutting circuitry shown in the application entitled "Notch Cutting Circuit with Minimal Power Dissipation" filed on even date herewith. In either event, the signals at terminals Q9 and Q10 of counter 10 operate to turn "on" switches which are preferably gate turn-on thyristors (GTO's) so as to produce a notch in the waveform of power supplying the ballast of the fluorescent lights. Counter 10 is shown having a reset input "RES" operable to reset the counter to zero and thereafter outputs appear at Q9 and Q10 after certain predetermined counts have occurred. In this manner, the width and position of the notches is controlled, and the fluorescent light dimmed. The operation of this apparatus can be more clearly understood by reference to the above-mentioned co-pending application and will not be further described herein.

A zero crossing detector 30, which may be like that shown in the above-mentioned co-pending application, is shown at the left end of FIG. 1 receiving a supply of power from an alternating power source 31, which may be a secondary winding of the transformer which supplies power for this fluorescent lighting system, over a line 32, and operates to produce a positive output voltage pulse of short duration on line 35 every time the alternating current supplied to the detector 30 crosses the zero reference axis. The waveform of the signal on line 35 may be like that seen in FIG. 5 as waveform "B".

Figures 2, 3, 4, 5:
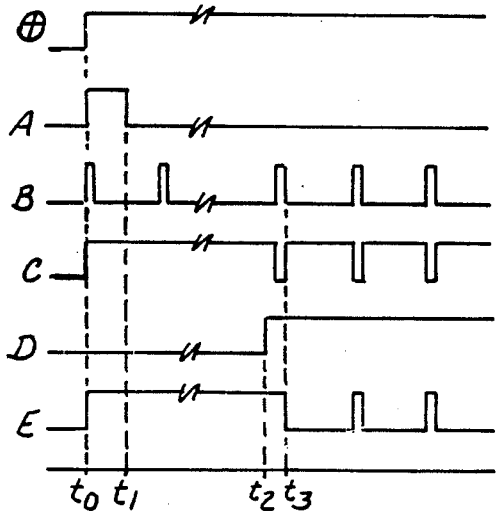
FIG. 2 is a logic chart for the "NOR" gate of FIG. 1.
FIG. 3 is a logic chart for the "NAND" gates of FIG. 1.
FIG. 4 is a logic chart for the "NAND" latch of FIG. 1.
FIG. 5 is a timing chart showing the outputs at various points in the circuitry of FIG. 1.

The output of detector 30 is connected by a line 37 to input pin 1 of a NAND gate 40 also having an input pin 2 and an output pin 3. The logic table for NAND gate 40 is shown in FIG. 3.

A diode 42 is shown with its cathode connected to line 35 and its anode connected to a junction point 44 which, in turn, is connected to input pin 1 of a NOR gate 46 by a connection 48. NOR gate 46 also has an input pin 2 and an output pin 3, and its logic table may be seen in FIG. 2.

A source of positive voltage 50 is shown having an output connected to a junction point 52, and a resistor 54 is shown connected between junction point 52 and junction point 44.

Input pin 2 of NOR gate 46 is shown connected to a junction point 56, and a capacitor 60 is shown connected between junction points 52 and 56. Junction point 56 is also connected to the cathode of a diode 62, the anode of which is connected to a junction point 64, and a resistor 66 is connected between junction points 56 and 64. A capacitor 68 is shown connected between junction points 44 and 64. Junction point 64 is also connected to the 0 potential ground signal of the positive voltage source. Resistor 54 and capacitor 68, in combination with diode 42, operate as a lost cycle or power "off" circuit, as will be hereinafter described. Capacitor 60, in combination with resistor 66 and diode 62, operates as a power on reset signal producing circuit, as will also hereinafter be described.

The output pin 3 of NOR gate 46 is shown connected to the input of a first inverter 70 whose output is connected to a junction point 72 which is, in turn, connected to the input of a second inverter 74 having an output connected to a junction point 76. Junction point 72 is connected to a terminal 80 to supply a signal to the circuitry shown in the above-mentioned co-pending application to temporarily turn "off" the GTO switches upon initial startup and thus cause the first short delay, as will be further explained below.

Junction point 76 is connected to input pin 2 of a NAND latch circuit 81 shown in dashed lines and comprising a first NAND gate 82 which has the input pin 2 and an output pin 4, and a second NAND gate 84 having an input pin 1 and an output pin 3. The other input of NAND gate 82 is connected to output pin 3 of NAND gate 84 and the other input of NAND gate 84 is connected to output pin 4 of NAND gate 82. The logic table for NAND latch 81 is shown in FIG. 4.

Junction point 76 is also connected to the cathode of a diode 90 whose anode is connected to a junction point 92, and a resistor 94 is connected between junction points 76 and 92. Junction point 92 is shown connected to input pin 2 of NAND gate 40 and also connected through a capacitor 96 to signal ground.

The output pin 3 of NAND gate 40 is connected to a junction point 100 which is also connected to an input pin 1 of a NAND gate 102. NAND gate 102 has an input pin 2 and an output pin 3. The input pin 2 of NAND gate 102 is connected to output pin 3 of NAND latch 81, and output pin 3 of NAND gate 102 is connected to the reset input of counter 10 by a line shown as arrow 104.

The operation of FIG. 1 will best be understood by reference to FIGS. 1–5 in connection with the following description.

As explained above, it is desirable, after the control circuit for the fluorescent light has been in an "off" condition, to delay any signal calling for dimming of the fluorescent light upon the initialization thereafter and, instead, to power the fluorescent tube a full "on" signal without dimming for a predetermined period of time necessary to allow the filament to warm up. By this means, the life of the fluorescent light is extended. Also, as explained above, it is desirable for a very brief period of time after the initial startup to apply no power at all to the fluorescent light to allow an initial stabilization period for the electronic components in the circuitry. To accomplish the very brief turn "off" of the power to the fluorescent light after the initial startup, a signal at output 80 is employed which operates to turn "off" the GTO's and SCR's which supply power to the ballast of the fluorescent light, as described in the above-mentioned co-pending application. More particularly, in the above-mentioned co-pending application, the NOR gate at the bottom of FIG. 5C is shown having a "POR" output. This "POR" output causes the turn-off of the SCR's and GTO's to prevent power from being applied to the fluorescent light. The signal at junction 80 of the present invention may be utilized as the "POR" signal in the co-pending application FIG. 5C, and this keeps the power "off" to the lamp so long as the signal exists at terminal 80. Then, when the signal at terminal 80 disappears after the first delay period in order to delay the application of a dimming signal to the fluorescent light, a signal is maintained for a period of time at the reset input of counter 10 so that counter 10 cannot count which prevents any outputs at Q9 and Q10 to appear during this period. More particularly, in the circuitry of the above-described application, the output of the dimming control circuitry will either be calling for a "full on" condition, a "full off" condition, or some dimming signal between "full on" and "full off". If, of course, the dimming control circuit is calling for a "full off" signal after the first delay period, there will be no signal at all sent to the fluorescent lamp since both the GTO's and the SCR's, as in FIG. 5A of the co-pending application, will be "off". If the dimming control circuitry is calling for a "full on" signal, then the GTO's of FIG. 5A will be "off" but the SCR's of FIG. 5A will be "on" and the fluorescent light will receive a "full on" signal and no problem will occur. If, however, the dimming control circuitry is calling for some dimming signal, then the operation of the present invention comes into play to prevent the dimming signal from being applied to the fluorescent light until the proper delay periods have elapsed. This occurs when there is a continual reset signal since the dimming signal appearing at terminals Q9 and Q10 of the counter cannot appear and, in FIG. 5A of the co-pending application, with no signals appearing at terminals Q9 and Q10 the output of NAND gate 114 will be high thereby turning the GTO's "on" with no dimming. This is the desired condition of operation of the present invention as will now be described.

At startup time $t_0$ shown in FIG. 5, the zero crossing detector will immediately begin to produce output pulses as shown on line "B", and the power from the DC source 50 will immediately be applied to the circuit as shown along the uppermost line. At this time, the output of DC source 50 goes positive to produce a "high" or "1" signal at junction point 52 and a "low" or "0" signal exists on lines 35 and 37 except for the very short period of time (approximately 100 microseconds) when a pulse produces a "1" signal thereon.

At the instant a "1" signal appears at junction point 52, capacitor 60 will act as a short circuit for a very short period of time so that input pin 2 of NOR gate 46 will initially receive a "1". At this time, junction point 44 is substantially a "0" since diode 42 will discharge any voltage buildup on capacitor 68 and, accordingly, input pin 1 of NOR gate 46 will continually have a "0" signal thereon. With pin 1 being "0" and pin 2 being "1", the signal at output pin 3 of NOR gate 46 will be a "0" (see FIG. 2) and, accordingly, the output of inverter 70 at junction point 72 and output terminal 80 will be a "1" as shown in line "A" of FIG. 5. As explained above, a "1" signal on terminal 80 will operate to turn "off" the SCR's and GTO's in the circuitry of the above-described co-pending application and prevent the application of power to the fluorescent light for as long as the "1" signal exists. This will be approximately two to three seconds, as will be described below.

Since a "1" signal exists at junction 72, the signal at junction 76 will be "0" so that the lower end of resistor 94 and the cathode of diode 90 will be low and the input to input pin 2 of latch circuit 81 will be a "0". While junction point 76 is low, junction point 92 will also be low and, accordingly, the signal on input pin 2 of NAND gate 40 will be "0". Since input pin 1 of NAND gate 40 is now receiving, on line 37, the pulsed signals shown on line "B" of FIG. 5, pin 1 will be receiving a "0" during a majority of the time with "1" pulses periodically applied at the "0" crossover points determined by detector 30. Accordingly, the output signal at pin 3 of NAND gate 40 will be a continuous "1", as seen on line "C" of FIG. 5, regardless of the signal at pin 1 (see FIG. 3). Junction point 100 is therefore high and input pin 1 of latch 81 and input pin 1 of NAND gate 102 will both receive a "1" at this time. With a "1" at input pin 1 of latch 81 and a "0" at input pin 2 of latch 81, the signal on pin 3 of latch 81 will be a "0", as seen on line "D" of FIG. 5, and the signal on pin 4 of latch 81 will be "1" (see FIG. 4). Accordingly, input pin 2 of NAND gate 102 will receive a "0" and the output pin 3 of NAND gate 102 will produce a "1" signal, as seen on line "E" of FIG. 5 (see FIG. 3). The "1" signal at output pin 3 of NAND gate 102 is applied to counter 10 at the reset input and, as explained above, will prevent counter 10 from counting and thus prevent signals from appearing at terminals Q9 and Q10 to notch cutting circuit 20.

After two or three seconds, depending on the values of resister 66 and capacitor 60, at a time $t_1$, capacitor 60 will have charged up sufficiently to bring terminal 56 down below the threshold of NOR gate 46 and a "0" signal will be applied to input pin 2 of NOR gate 46. Pin 1 of NOR gate 46 will still receive a "0" and, accordingly, the output pin 3 of NOR gate 46 will now become a "1", which means that the junction point 72 at the output of inverter 70 will become "0", as seen on line "A" of FIG. 5, and terminal 80 will no longer supply a positive signal to the circuitry of the above-mentioned co-pending application and the circuitry will become operational so that full "on" power will be supplied through the GTO's to the fluorescent lights as is desired, because any dimming signals being called for will not produce outputs at Q9 and Q10 of counter 10, as will be described below.

With a low signal at junction point 72, the output of inverter 74 will now be high and, accordingly, junction point 76 will be high as will the input pin 2 of latch 81. The lower portion of resistor 94 and the cathode of diode 90 will now receive a "high" signal, but because capacitor 96 has not yet charged, input pin 2 of NAND gate 40 will remain low until such time as capacitor 96 charges sufficiently (approximately 10 seconds depending on the values of capacitor 96 and resistor 94). Accordingly, the inputs to NAND gate 40 do not change at this time and output pin 3 as well as junction point 100 will remain high. Input pin 1 of latch 81 is now receiving a "1" while input pin 2 of latch 81 also receives a "1" and, from the chart in FIG. 4, it will be determined that the latch has a "N.C." at output pins P3 and P4 indicating "no change". Accordingly, output pin 4 will remain high and output pin 3 will remain low. NAND gate 102 will therefore receive the same inputs it was receiving at the very start, and output pin 3 will continue to be high so that a high signal at the reset terminal of counter 10 will prevent counter 10 from operating and no signals will appear on outputs Q9 and Q10. This allows the "full on" circuitry of the co-pending application to operate as described above and prevents the notch carving circuit 20 from causing dimming of the fluorescent lights.

After about 10 seconds at a time $t_2$, in FIG. 5, capacitor 96 will have charged sufficiently to pass the threshold of NAND gate 40 and a "1" signal will appear at input pin 2 thereof, as shown by line "D" of FIG. 5. When this occurs, output pin 3 will produce a "0" output for each "1" input at input pin 1 and will produce a "1" output for each "0" at input pin 1. Thus, the signal on terminal 100 will be the opposite of the signal on line 37 as may be seen on line C of FIG. 5. Accordingly, input pin 1 of latch 81 will now receive a "1" except at the zero crossover points when "0" pulses will appear. Since input pin 2 of latch 81 is now receiving a "1" signal, output pin 3 of latch 81 will be "high" and this will not change even on the "high" or "1" signal at input pin 1 since two "1" inputs produce no change in latch 81. Accordingly, input pin 2 of NAND gate 102 will now receive a "1" at all times. Under these circumstances, output pin 3 of NAND gate 102 will produce a "0" signal whenever the signal at input pin 1 is a "1" and will produce a "1" signal whenever the signal at input pin 1 is a "0". Accordingly, the signal on output pin 3 will be the reverse of the signal at terminal 100 which it will be remembered is the reverse of the output of the zero crossing detector 30, as seen on line "E" of FIG. 5. Accordingly, from this point on the reset input to counter 10 will be the same as the output of zero crossing detector 30, and counter 10 will be enabled to operate in its normal fashion to produce outputs at Q9 and Q10 which will turn "on" the GTO switches in the circuitry of the above-described application to carve the notches in the power supply to the fluorescent light and thus cause dimming.

This will continue for as long as the power supply remains activating the fluorescent lights. In the event of a power failure or if the system is turned "off", the signal from the DC supply 50 remains positive for a short period of time due to power supply capacitors (not shown). However, the zero crossing circuit is designed such that with no AC zero crossing voltages present, its output 35 remains high (1) allowing input pin 1 of NOR gate 46 to become positive through the charging of capacitor 68 from the remaining DC supply voltage through resistor 54. With input pin 1 receiving a "1" and input pin 2 receiving a "0", output pin 3 will produce a "0" and junction 72 and terminal 80 will briefly be high while junction point 76 will be low allowing capacitor 96 to discharge through diode 90 and bring input pin 2 of NAND gate 40 to a "0" condition. This produces a "1" at output pin 3 of NAND gate 40 which will produce a "1" at input pin 1 of latch 81 while input pin 2 of latch 81 is receiving a "0" and, accordingly, from FIG. 4 it is seen that the output on pin 3 of latch 81 will become "0". NAND gate 102 will therefore have a "1" at input pin 1 and a "0" at input pin 2 so that the signal at output pin 3 will be a "1", and counter 10 will receive a reset signal preventing further operation. Accordingly, it is seen that the circuit will assume the condition it was in prior to startup and will be ready for the next startup cycle to occur.

Although the present invention has been described with reference to preferred embodiments, workers skilled in the art will recognize that changes may be made in form and detail without departing from the spirit and scope of the invention.

What is claimed is:

1. Apparatus for use with a fluorescent light dimming circuit, the dimming circuit being operatable to receive an AC signal from a power source, the dimming circuit including a "notch" cutting circuit, the "notch" cutting circuit having an input to receive control signals from control means indicative of a desired dimming, the notch cutting circuit producing an output operable to cut a notch in the AC signal supplied by the power source to the fluorescent light to produce the desired dimming, the apparatus being operable upon a "startup" condition to inhibit the input to the notch cutting circuit for a predetermined time period so as to prevent dimming of the fluorescent light comprising:

delay means operable upon said "startup condition to produce an output signal for the predetermined time period; and means connecting the delay means to the control means to prevent the output of said control signals therefrom, the control means operating to interrupt the signal to the input of the "notch" cutting means during the period that the output signal from the delay means continues.

2. Apparatus according to claim 1 wherein the control means is a counter having a clock input, a reset input and a control output, the clock input receiving dimming signals indicative of desired dimming, the counter normally counting up to a predetermined value at which the counter then produces control signals to the notch cutting circuit, and the reset input being connected to the delay means so that the output signal from the delay means disables the counter during the predetermined time period to prevent the control signals.

3. Apparatus according to claim 2 wherein the absence of control signals to the notch cutting circuit causes the power from the power source to be applied to the fluorescent light without a "notch" during the predetermined time period.

4. Apparatus according to claim 1 further including additional delay means, the additional delay means operable upon "startup" to produce an "off" signal which prevents the application of power to the fluorescent light during a "warm up" period.

5. Apparatus according to claim 4 wherein the "warm up" period is chosen to be sufficiently long to allow the electrical components to stabilize and the predetermined time period exceeds the warm-up period by a time sufficient to allow the filaments of the fluorescent light to acquire operational status before any dimming signal permits the "notch" cutting circuit to produce the desired dimming.

6. Delay means for use with a dimming circuit for a fluorescent light which is normally connected to receive energizing power from a power source, the dimming circuit operable upon receipt of a first input signal to prevent the application of power from the power source to the fluorescent light and upon receipt of a second signal to periodically interrupt the application of power from the power source to the fluorescent light to produce dimming and upon receipt of a third input signal to prevent the operation of the second input signal and to cause the continuous application of power from the power source to the fluorescent light, the delay means producing a first output from a first time to a second time and producing a second output from at least the second time to a third time, the first output being connected to the dimming circuit to supply the first input thereto and the second output being connected to the dimming circuit to supply the third input thereto and dimming control means connected to the dimming circuit to supply the second input thereto.

7. Apparatus according to claim 6 wherein the dimming circuit operates to produce an output which upon receipt of the second input opens the circuit from the power source to the fluorescent light so as to "notch" the power and cause dimming.

8. Apparatus according to claim 7 wherein the delay means includes a first time delay circuit which is activated at a "startup" time to produce the first output and the period from the first time to the second time is sufficient to allow the components of the dimming circuit to stabilize.

9. Apparatus according to claim 8 wherein the delay means includes a second time delay circuit which is activated before the second time to produce the second output and the period from the second time to the third time is sufficient to allow the fluorescent light filament to warm up.

10. Apparatus according to claim 9 wherein the dimming circuit includes a counter having a clock input connected to receive the second input signal and a reset input to receive the third input signal.

11. Apparatus according to claim 10 wherein the counter produces a notch cutting signal whenever the count reaches a desired number before a reset signal input is received and the notch cutting signal operates to periodically interrupt the application of power from the power source to the fluorescent light.

12. Delay means for use with a fluorescent lamp dimming circuit which includes a counter having a first output occurring after a first predetermined count, a first input for receiving a desired dimming signal from a dimming control circuit, the dimming control signal operable to determine the first predetermined count and having a reset input for resetting the counter to a start level, comprising:

reference means receiving an alternating waveform input and producing an output at a predetermined point in the alternating waveform; and delay means connected to receive the output from the reference means and to produce a first reset output signal to the reset input of the counter to prevent the counter from counting for a first predetermined time period sufficient to allow the lamp to warm up and thereafter to produce a second reset output signal to the reset input of the counter to permit the counter to count to allow a dimming signal to be applied to the lamp.

13. Apparatus according to claim 12 wherein the reference means is a zero crossing detector and the output therefrom is a pulse occurring at each zero crossing of the alternating waveform.

14. Apparatus according to claim 12 wherein the delay means includes a first signal delay circuit, and the first reset output signal is a positive DC signal.

15. Apparatus according to claim 14 wherein the first delay circuit includes a resistor and a capacitor.

16. Apparatus according to claim 14 wherein the second reset output is a zero signal.

17. Apparatus according to claim 14 wherein the delay means further includes a second signal delay circuit operable to produce a control output for a second predetermined time period which is less than the first predetermined time period to allow the electronic components to stabilize before applying power to the lamp.

* * * * *